US010245713B2

(12) United States Patent
Lee

(10) Patent No.: US 10,245,713 B2
(45) Date of Patent: Apr. 2, 2019

(54) EXPLOSIVE DISCHARGE ACTUATED TOOL FOR DRIVING FASTENERS

(71) Applicant: Chung-Yi Lee, New Taipei (TW)

(72) Inventor: Chung-Yi Lee, New Taipei (TW)

( * ) Notice: Subject to any disclaimer, the term of this patent is extended or adjusted under 35 U.S.C. 154(b) by 414 days.

(21) Appl. No.: 15/271,866

(22) Filed: Sep. 21, 2016

(65) Prior Publication Data

US 2017/0266797 A1 Sep. 21, 2017

(30) Foreign Application Priority Data

Mar. 18, 2016 (TW) ..... 105203750 U

(51) Int. Cl.
*B25C 1/18* (2006.01)
*B25C 1/14* (2006.01)

(52) U.S. Cl.
CPC ..... *B25C 1/18* (2013.01); *B25C 1/143* (2013.01)

(58) Field of Classification Search
CPC ..... B25C 1/18; B25C 1/143
USPC ..... 227/9, 10
See application file for complete search history.

(56) References Cited

U.S. PATENT DOCUMENTS 3,746,235 A * 7/1973 Crabtree, Jr. ..... B25C 1/14 227/10
4,068,790 A * 1/1978 Osterle ..... B25C 1/18 227/8
4,221,430 A * 9/1980 Frobose ..... A47C 7/402 297/353
4,622,765 A * 11/1986 Baratto ..... A43B 5/0452 36/118.7
4,883,212 A * 11/1989 Philipp ..... B25C 1/18 227/9
5,029,744 A * 7/1991 Pai ..... B25C 1/143 227/10
5,657,919 A * 8/1997 Berry ..... B25C 1/143 173/DIG. 2
5,699,948 A * 12/1997 Lee ..... B25C 1/14 227/10
5,732,869 A * 3/1998 Hirtl ..... B25C 1/143 227/10
6,032,846 A * 3/2000 Clark ..... B25C 1/14 227/10
6,039,229 A * 3/2000 Pfister ..... B25C 1/14 227/10
6,161,745 A * 12/2000 Grazioli ..... B25C 1/18 227/10
2002/0104867 A1* 8/2002 Wohlwend ..... B25C 1/18 227/9
2003/0098328 A1* 5/2003 Fielitz ..... B25B 27/0085 227/10

(Continued)

*Primary Examiner* — Alexander M Valvis
*Assistant Examiner* — Lucas E. A. Palmer
(74) *Attorney, Agent, or Firm* — Hamre, Schumann, Mueller & Larson, P.C.

(57) ABSTRACT

An explosive discharge actuated tool includes a piston disposed in a barrel to be driven by a combustion gas for exerting a striking power to strike a fastener out of the barrel. A power adjusting unit is disposed to adjust an opening area of an exhaust port for the combustion gas, and includes an adjusting pin movable longitudinally to completely or partially close the exhaust port so as to adjust the striking power, and an engaging block coupled to the adjusting pin through a latch spindle to be moved transversely to allow or prevent movement of the adjusting pin relative to the exhaust port.

13 Claims, 12 Drawing Sheets

(56) References Cited

U.S. PATENT DOCUMENTS

| | | | | |
|---|---|---|---|---|
| 2004/0182907 | A1* | 9/2004 | Dittrich | B25C 1/14 227/10 |
| 2006/0225905 | A1* | 10/2006 | Elmvist | B25C 1/047 173/197 |
| 2009/0315237 | A1* | 12/2009 | Thomas | B23D 45/048 269/63 |
| 2010/0258609 | A1* | 10/2010 | Lee | B25C 1/143 227/10 |
| 2011/0168754 | A1* | 7/2011 | Lee | B25C 1/146 227/9 |
| 2012/0037683 | A1* | 2/2012 | Lee | B25C 1/143 227/10 |
| 2013/0270319 | A1* | 10/2013 | Gauger | B25C 1/08 227/2 |
| 2015/0034693 | A1* | 2/2015 | Ronconi | B25C 1/008 227/8 |
| 2016/0311096 | A1* | 10/2016 | Blessing | B25C 1/143 |
| 2016/0311098 | A1* | 10/2016 | Blessing | B25C 1/143 |
| 2018/0043519 | A1* | 2/2018 | Dill | B25C 1/06 |

* cited by examiner

EXPLOSIVE DISCHARGE ACTUATED TOOL FOR DRIVING FASTENERS

CROSS-REFERENCE TO RELATED APPLICATION

This application claims priority of Taiwanese Patent Application No. 105203750, filed on Mar. 18, 2016.

FIELD

The disclosure relates to an explosive discharge actuated tool for driving fasteners, and more particularly to an explosive discharge actuated tool with a power adjusting unit for adjusting a striking power applied to fasteners.

BACKGROUND

A conventional explosive discharge actuated tool for driving fasteners generally includes a piston that is actuated by the gas of an explosive discharge to strike fasteners out of a barrel. The striking power is regulated using different discharge cartridges. Another way to adjust the striking power is controlling the venting of a combustion gas in the firing chamber, such as that disclosed in U.S. Pat. No. 6,032,846.

SUMMARY

An object of the disclosure is to provide an explosive discharge actuated tool for driving fasteners that has a power adjusting unit which is operable easily to rapidly adjust a piston with a desired striking power.

According to the disclosure, the explosive discharge actuated tool includes a tubular housing extending in a longitudinal direction, and having an opening which extends in a first transverse direction transverse to the longitudinal direction to define a mounting surface, and a plurality of retaining recesses which are disposed on the mounting surface, and which are displaced from each other in the longitudinal direction. A barrel is mounted in and movable relative to the tubular housing in the longitudinal direction, and includes a rear segment defining an accommodation chamber for receiving an explosive cartridge, and a barrel body extending from the rear segment forwardly and defining a barrel bore which is in fluid communication with the accommodation chamber. The barrel body has an exhaust port which is located proximate to the rear segment and downstream of the accommodation chamber for discharging a combustion gas. A piston is disposed in the barrel bore and is driven by the combustion gas so as to exert a striking power to strike a fastener out of the barrel. The piston has a trailing end disposed forwardly of the accommodation chamber to define, in a pre-firing position, a combustion chamber in the barrel bore so as to generate the combustion gas when the explosive cartridge is detonated. A power adjusting unit includes an adjusting pin, a latch spindle and an engaging block. The adjusting pin has a blocking region and is disposed to be movable relative to the barrel in the longitudinal direction so as to permit the blocking region to completely or partially close the exhaust port. The latch spindle has an actuated end and a latch end which is opposite to the actuated end in the first transverse direction, and which is disposed to be movable relative to the adjusting pin in the first transverse direction between a shiftable position where the latch spindle is movable with the adjusting pin in the longitudinal direction, and a non-shiftable position where the latch spindle is prevented from moving with the blocking region in the longitudinal direction. The engaging block is sleeved on and movable with the latch spindle in the first transverse direction and having a protuberance which is configured to be movable between an engaged position where the protuberance is engaged in a selected one of the retaining recesses so as to prevent the latch spindle from moving away from the non-shiftable position, and a disengaged position where the protuberance is disengaged from the selected one of the retaining recesses to place the latch spindle in the shiftable position.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
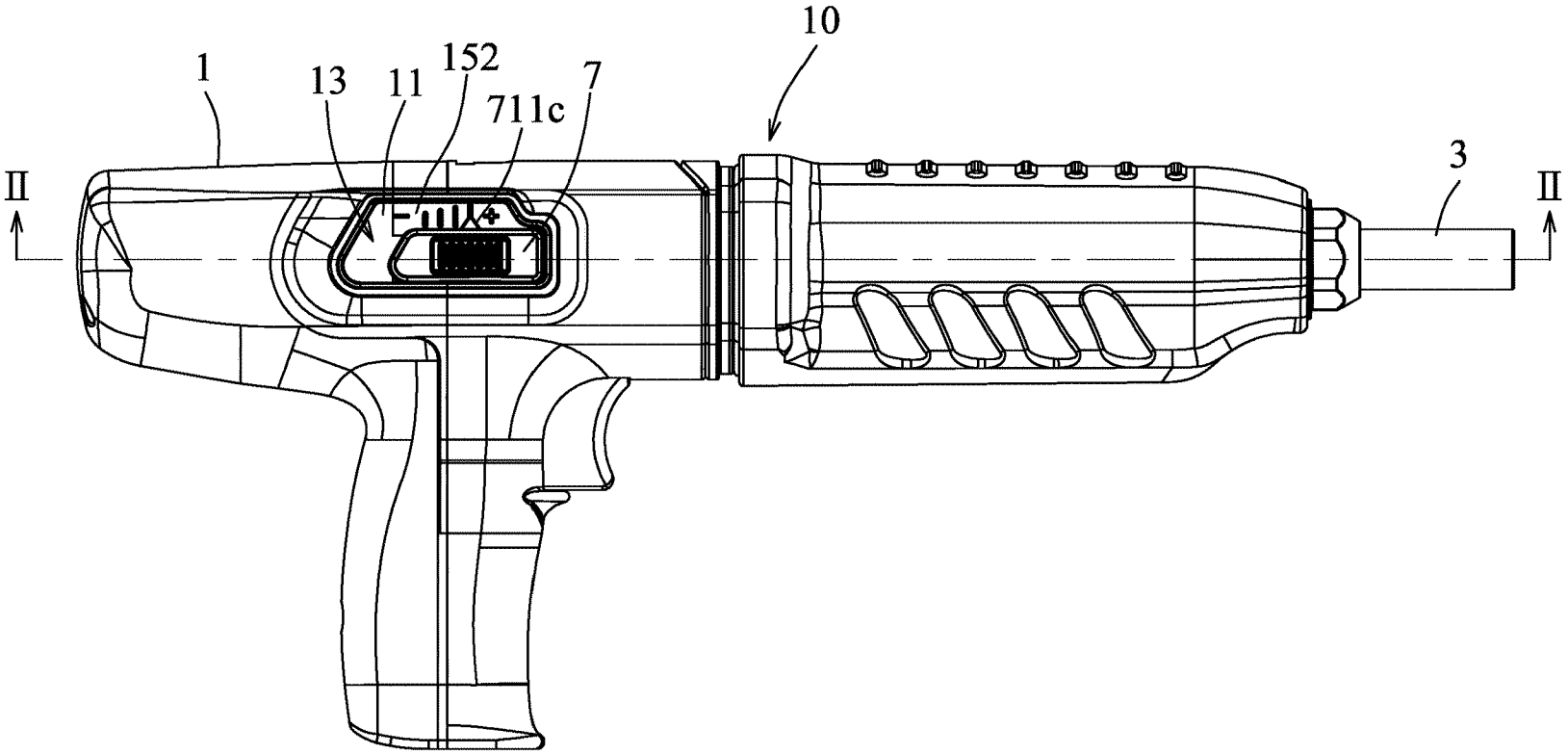
FIG. 1 is a schematic side view illustrating an embodiment of the explosive discharge actuated tool according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
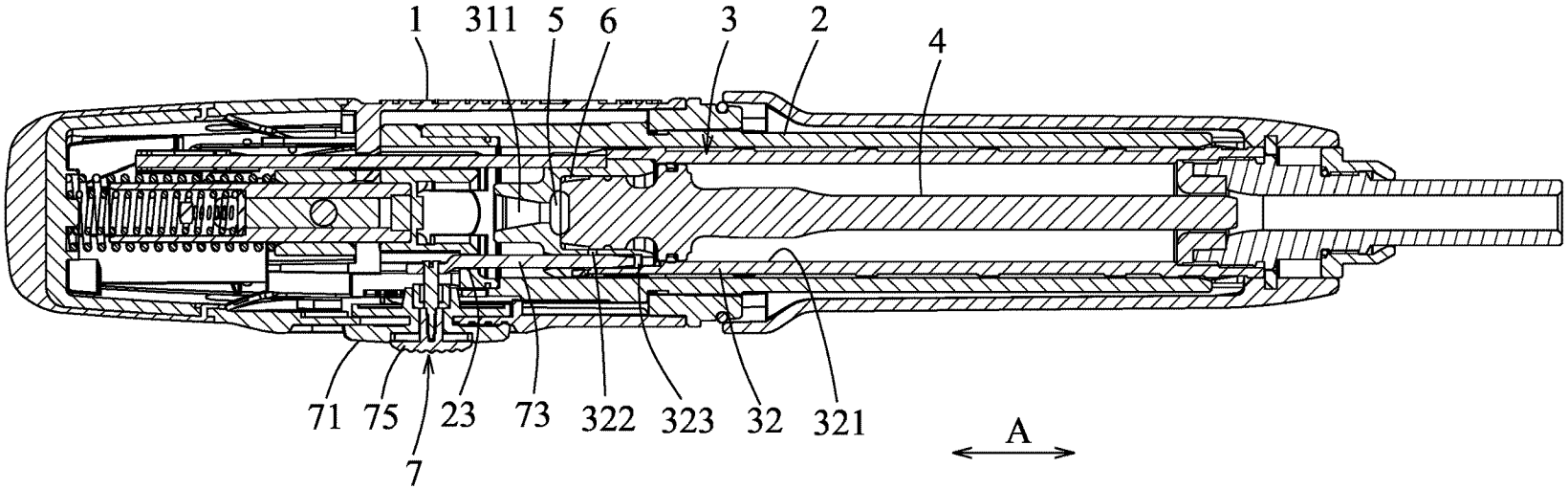
FIG. 2 is a sectional view taken along line II-II of FIG. 1.
Figure 3:
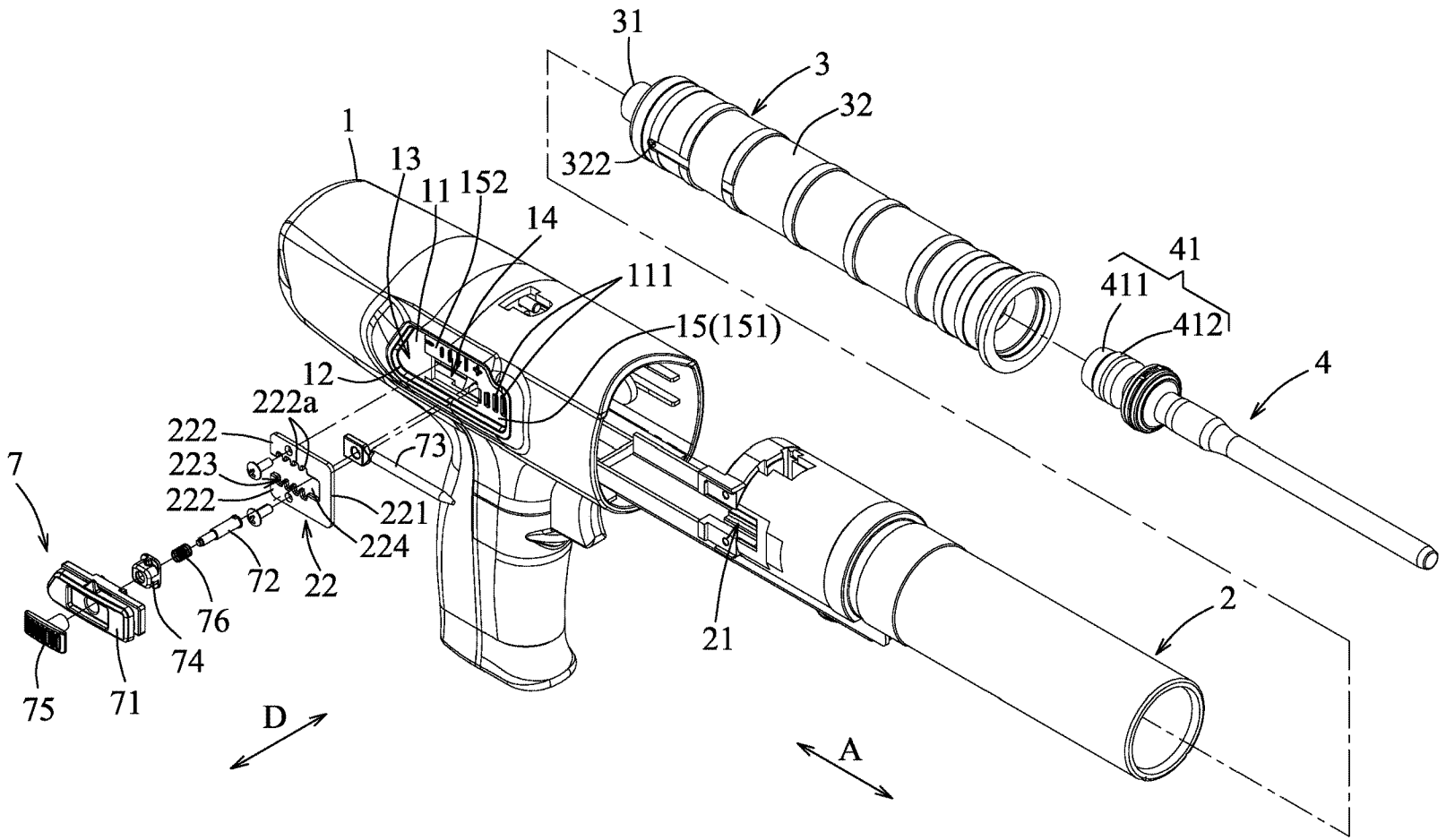
FIG. 3 is an exploded perspective view of the embodiment.

Referring to FIGS. 1 to 3, an embodiment of the explosive discharge actuated tool for driving fasteners according to this invention is shown to include a tubular housing 10, a barrel 3, a piston 4 and a power adjusting unit 7.

The tubular housing 10 extends in a longitudinal direction (A), and includes a shell body 1 and a tubular body 2. The shell body 1 is of a gun shape and surrounds the tubular body 2. The shell body 1 has a cutout portion 13 which is defined by a base wall 11 and a side wall 12, and which is formed with an access bore 14 in the base wall 11.

Figure 4:
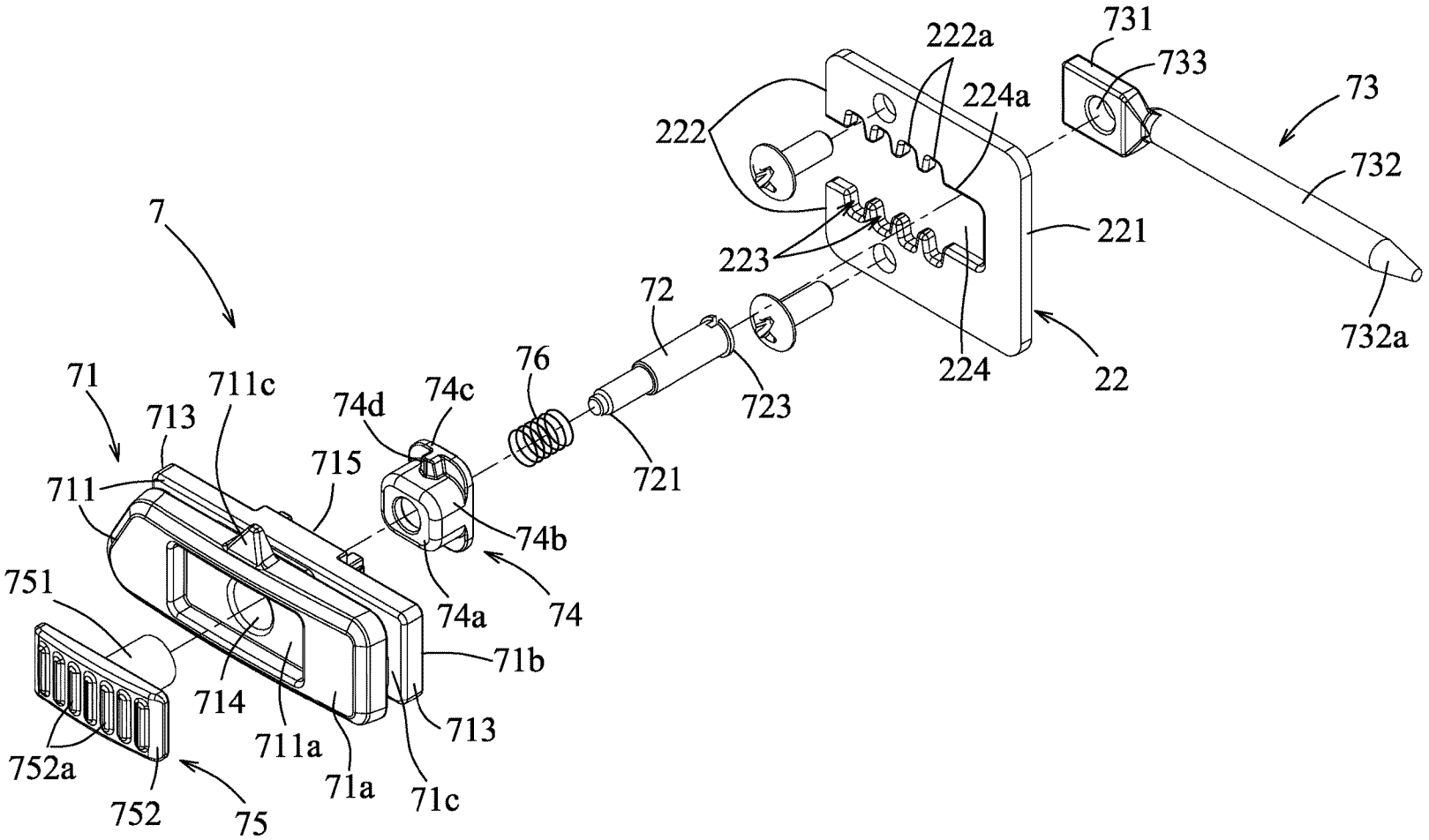
FIG. 4 is an exploded perspective view of a power adjusting unit of the embodiment.

Referring to FIGS. 2 to 4, the tubular body 2 is disposed for accommodating the barrel 3, and has a rear end portion which is formed with a guiding groove 21 extending in the longitudinal direction (A), and a longitudinal bore 23 extending in the longitudinal direction (A) and in communication with the guiding groove 21. A side plate 22 is configured to confront the access bore 14, and has a base portion 221 and two extending portions 222 extending from the base portion 221. The extending portions 222 are spaced apart from each other by a longitudinal slot 224 that extends through the side plate 22 in a first transverse direction (D) transverse to the longitudinal direction (A) to serve as an opening of the tubular housing 10. The longitudinal slot 224 also extends in a second transverse direction which is transverse to both the longitudinal direction (A) and the first transverse direction (D) to form upper and lower surface regions (224*a*) that serve as a mounting surface. On the upper and lower surface regions (224*a*), upper and lower recess portions (222*a*) are respectively formed such that one of the upper recess portions (222*a*) and a corresponding one of the lower recess portions (222*a*) corporately serve as a retaining recess 223. Hence, a plurality of the retaining recesses 223 are disposed on the mounting surface, and are displaced from each other in the longitudinal direction (A). Moreover, an indexing plate 15 is integrally formed with the base wall 11, and has a front region 151 which is disposed forwardly from the longitudinal slot 224, and which has a plurality of indentations 111 that are disposed therein and that are displaced from each other in the longitudinal direction (A), and a rear region 152 which is disposed above the access bore 14, i.e., above the longitudinal slot 224.

Referring to FIGS. 2 and 3, the barrel 3 is mounted in and movable relative to the tubular body 2 in the longitudinal direction (A), and has a rear segment 31 defining an accommodation chamber 311 for receiving an explosive cartridge (not shown), and a barrel body 32 extending from the rear segment 31 forwardly and defining a barrel bore 321 which is in fluid communication with the accommodation chamber 311. The barrel body 32 has an exhaust port 322 which is located proximate to the rear segment 31 and downstream of the accommodation chamber 311 for discharging a combustion gas when less striking power is required for power adjustment.

Figure 6:
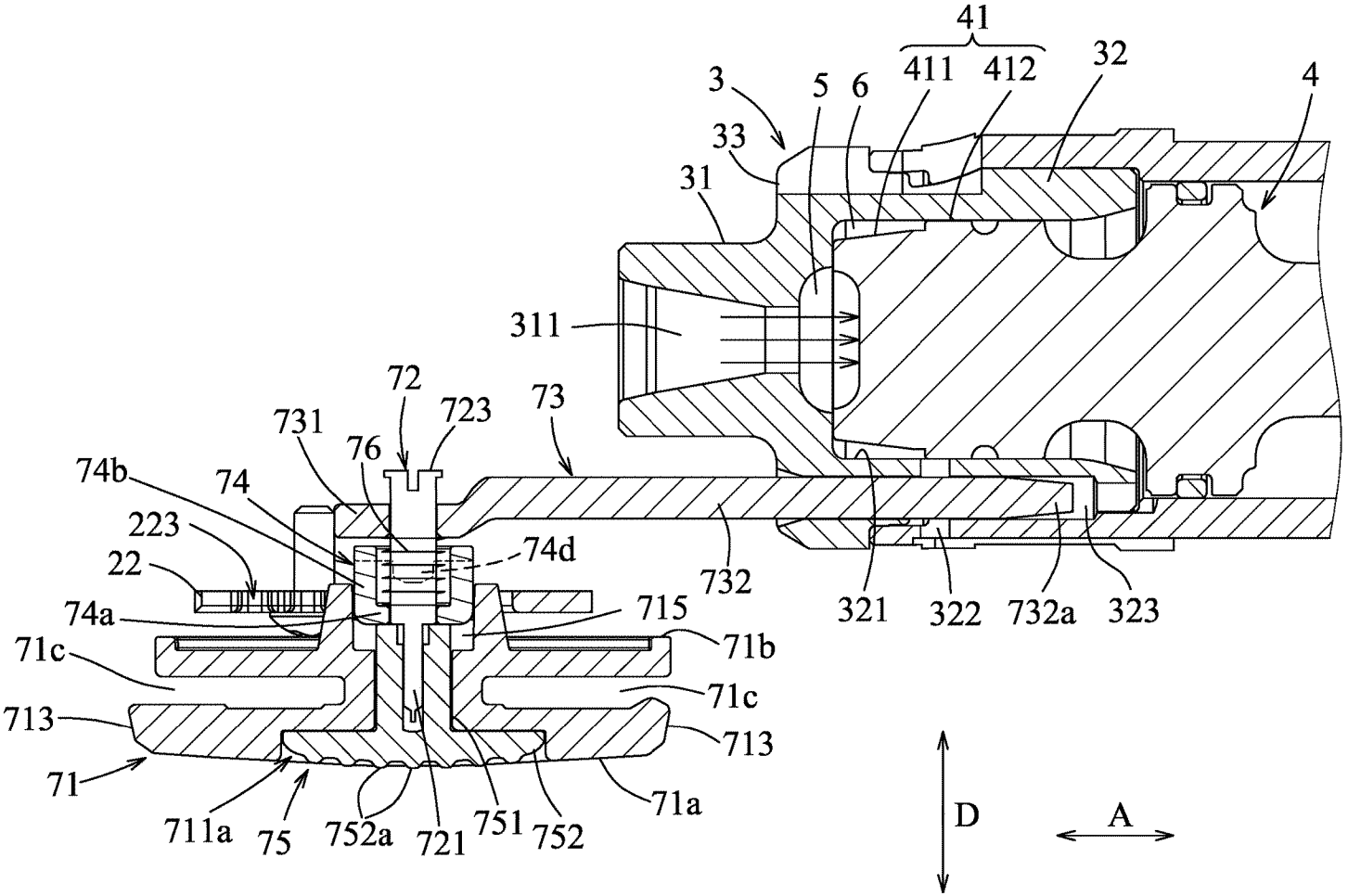
FIG. 6 is a fragmentary sectional view illustrating the power adjusting unit in an adjusting state.

Referring to FIG. 6, the barrel 3 has a shoulder surface 33 extending between the rear segment 31 and the barrel body 32, and having a guiding bore 323 which extends in the longitudinal direction (A) and which is aligned with the longitudinal bore 23 to corporately form a guiding channel that is communicated with and extends forwardly from the exhaust port 322.

Referring to FIGS. 2 and 3, the piston 4 is disposed in the barrel bore 321 and to be driven by the combustion gas so as to exert a striking power to strike a fastener (not shown) out of the barrel 3. The piston 4 has a trailing end 41 disposed forwardly of the accommodation chamber 311 and having a small-diameter segment 411 defining an annular clearance 6 with the barrel body 32, and a large-diameter segment 412 slidably engaged with the barrel body 32 to define, in a pre-firing position, a combustion chamber 5 in the barrel bore 321 so as to generate the combustion gas when the explosive cartridge is detonated. The combustion chamber 5 is in fluid communication with the exhaust port 322 through the annular clearance 6.

Figure 5:
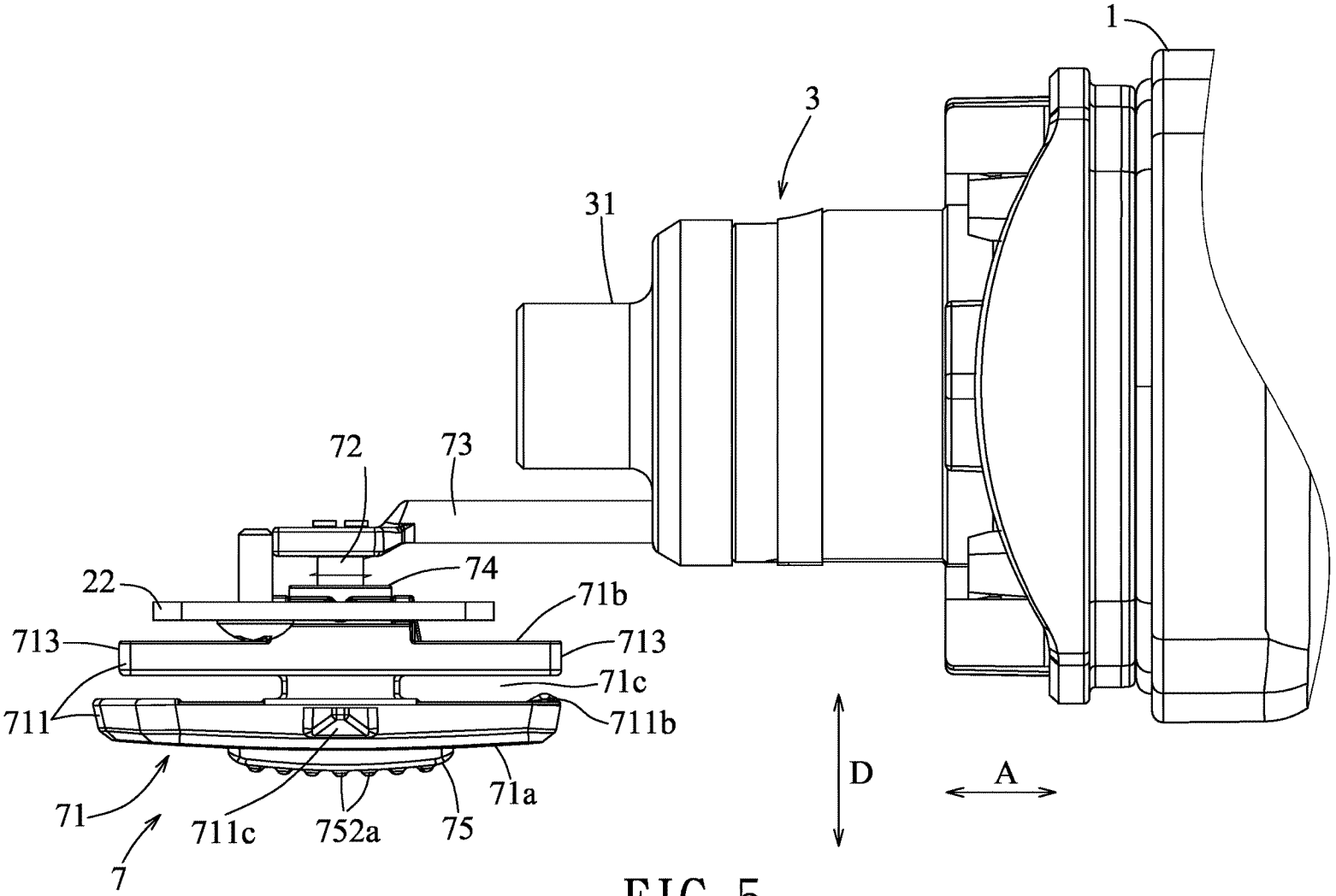
FIG. 5 is a fragmentary side view illustrating the power adjusting unit in a shiftable state.

Referring to FIGS. 3 to 5, the power adjusting unit 7 includes an adjusting pin 73, a latch spindle 72, an engaging block 74, a mounting body 71, an actuator 75 and a biasing spring 76.

The adjusting pin 73 has a latch region 731 defining a latched hole 733, and a blocking region 732 disposed in the guiding channel defined by the longitudinal and guiding bores 23, 323 to be movable relative to the barrel 3 in the longitudinal direction (A). The blocking region 732 extends forwardly to terminate at a front end which has a tapered end surface (732*a*). With reference to FIG. 6, the front end of the adjusting pin 73 can be moved forwardly from the exhaust port 322 so as to guide the blocking region 732 to completely or partially close the exhaust port 322.

Figure 7:
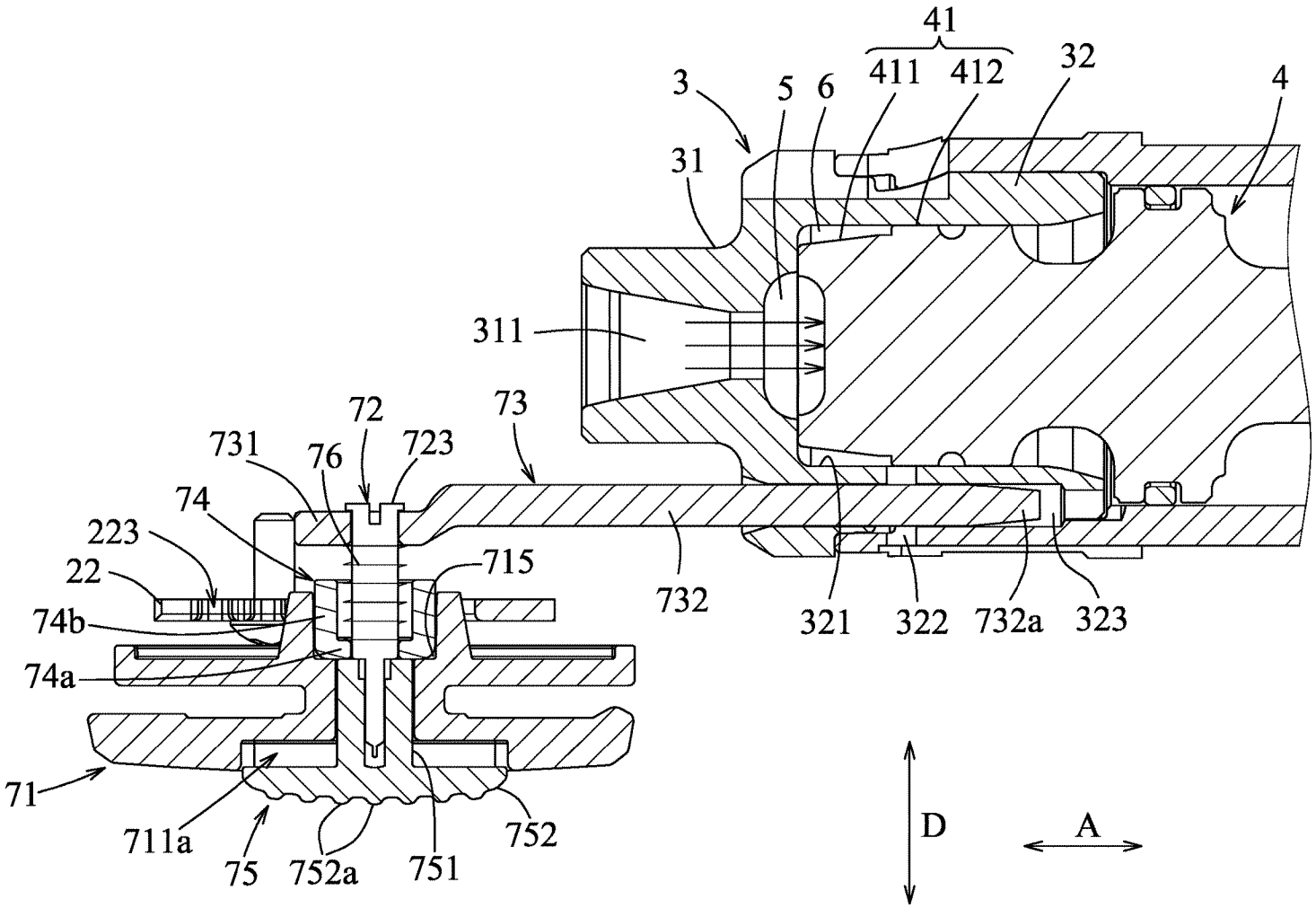
FIG. 7 is a fragmentary sectional view illustrating the embodiment in a state of high striking power.

The latch spindle 72 has an actuated end 721 and a latch end 723 opposite to each other in the first transverse direction (D). The latch end 723 is fitted in and movable relative to the latched hole 733 of the adjusting pin 73 in the first transverse direction (D) between a shiftable position (as shown in FIG. 6), where the latch spindle 72 is movable with the adjusting pin 73 in the longitudinal direction (A), and a non-shiftable position (as shown in FIG. 7), where the latch spindle 72 is prevented from moving with the adjusting pin 73 in the longitudinal direction (A).

The engaging block 74 is sleeved on and movable with the latch spindle 72 in the first transverse direction (D). The engaging block 74 has a tubular block body which includes a base wall (74*a*) having outer and inner wall surfaces, a surrounding wall (74*b*) extending from a periphery of the base wall (74*a*) in the first transverse direction (D) and toward the adjusting pin 73, and two flanges (74*c*) extending from the surrounding wall (74*b*) in the second transverse direction. Two protuberance portions (74*d*) are respectively disposed on the flanges (74*c*) to serve as a protuberance. The protuberance portions (74*d*) are configured to be movable between an engaged position, where the protuberance portions (74*d*) are engaged in a selected one of the retaining recesses 223 so as to prevent the latch spindle 72 from moving away from the non-shiftable position, and a disengaged position (as shown in FIG. 6), where the protuberance portions (74*d*) are disengaged from the selected one of the retaining recesses 223 to place the latch spindle 72 in the shiftable position.

The mounting body 71 has a socket cavity 715 in which the engaging block 74 is movably and non-rotatably fitted, and a through bore 714 extending in the first transverse direction (D) to communicate with the socket cavity 715. The socket cavity 715 and the tubular block body of the engaging block 74 may each have a rectangular cross-section (see FIG. 6). Specifically, the mounting body 71 has outward and inward surfaces (71*a*, 71*b*) opposite to each other in the first transverse direction (D) for the through bore 714 to extend therethrough. The outward surface (71*a*) has a receptacle recess (711*a*) extending inwardly. The mounting body 71 has front and rear side surfaces 713 which are formed between the outward and inward surfaces (71*a*, 71*b*) and opposite to each other in the longitudinal direction (A), and which respectively have front and rear spacing gaps (71*c*) that respectively extend toward the through bore 714 so as to form outer and inner shield segments 711. With reference to FIG. 5, an inner surface of the outer shield segment 711 has a protrusion (711*b*). The mounting body 71 has an index protrusion (711*c*) disposed on a top surface of the outer shield segment 711 and above the through bore 714. The indexing plate 15 (see FIG. 3) is disposed between the outer and inner shield segments 711 such that the protrusion (711*b*) is frictionally engaged in one of the indentations 111 so as to temporarily retain the mounting body 71 in the cutout portion 13. By virtue of the inner shield segment 711, the discharge powder is prevented from entering and gathering in the cutout portion 13 after the explosive cartridge is detonated.

The actuator 75 includes a stem 751 which is fitted in and movable relative to the through bore 714 between actuating and non-actuating positions, and which has a length longer than the depth of the through bore 714, and an enlarged head 752 which is connected to the stem 751, and which is configured to be fitted into the receptacle recess (711*a*) when the stem is moved from the non-actuating position to the actuating position. The enlarged head 752 has a plurality of friction ribs (752*a*) for facilitating operation by a user. With reference to FIG. 6, the stem 751 has a central hole, the actuated end 721 of the latch spindle 72 is configured to be securely engaged in the central hole of the stern 751 in either a screwing or press-fitting manner.

The biasing spring 76 is sleeved on the latch spindle 72 to abut against the adjusting pin 73 and the inner wall surface of the engaging block 74 so as to bias the engaging block 74 to the engaged position.

Referring to FIGS. 5 and 6, when the actuator 75 is actuated to push the latch spindle 72 and the engaging block 74 in the first transverse direction (D) toward the adjusting pin 73, the protuberance portions (74*d*) are displaced to disengage from the selected retaining recess 223 so as to place the latch spindle 72 in the shiftable position. In this state, the power adjusting unit 7 can be moved in the longitudinal direction (A) by the guiding of the guiding groove 21 (see FIG. 3) such that the adjusting pin 73 is moved to adjust the position of the blocking region 732 relative to the exhaust port 322. When the actuator 75 is released, the engaging block 74 can be moved to the engaged position by the biasing action of the biasing spring 76.

Referring to FIGS. 1, 3, 5 and 6, power indicator marks, i.e. "+", "−", and scale bars, are disposed on the rear region 152 to cooperate with the index protrusion (711*c*) to indicate the position of the mounting body 71 that corresponds to the position of the adjusting pin 73 relative to the exhaust port 322, so as to indicate the current striking power of the piston 4. It is noted that by the frictional engagement between the protrusion (711*b*) and one of the indentations 111 which are disposed to correspond with the retaining recesses 223, the user can feel the positioning of the mounting body 71 during the adjusting movement thereof.

Figure 8:
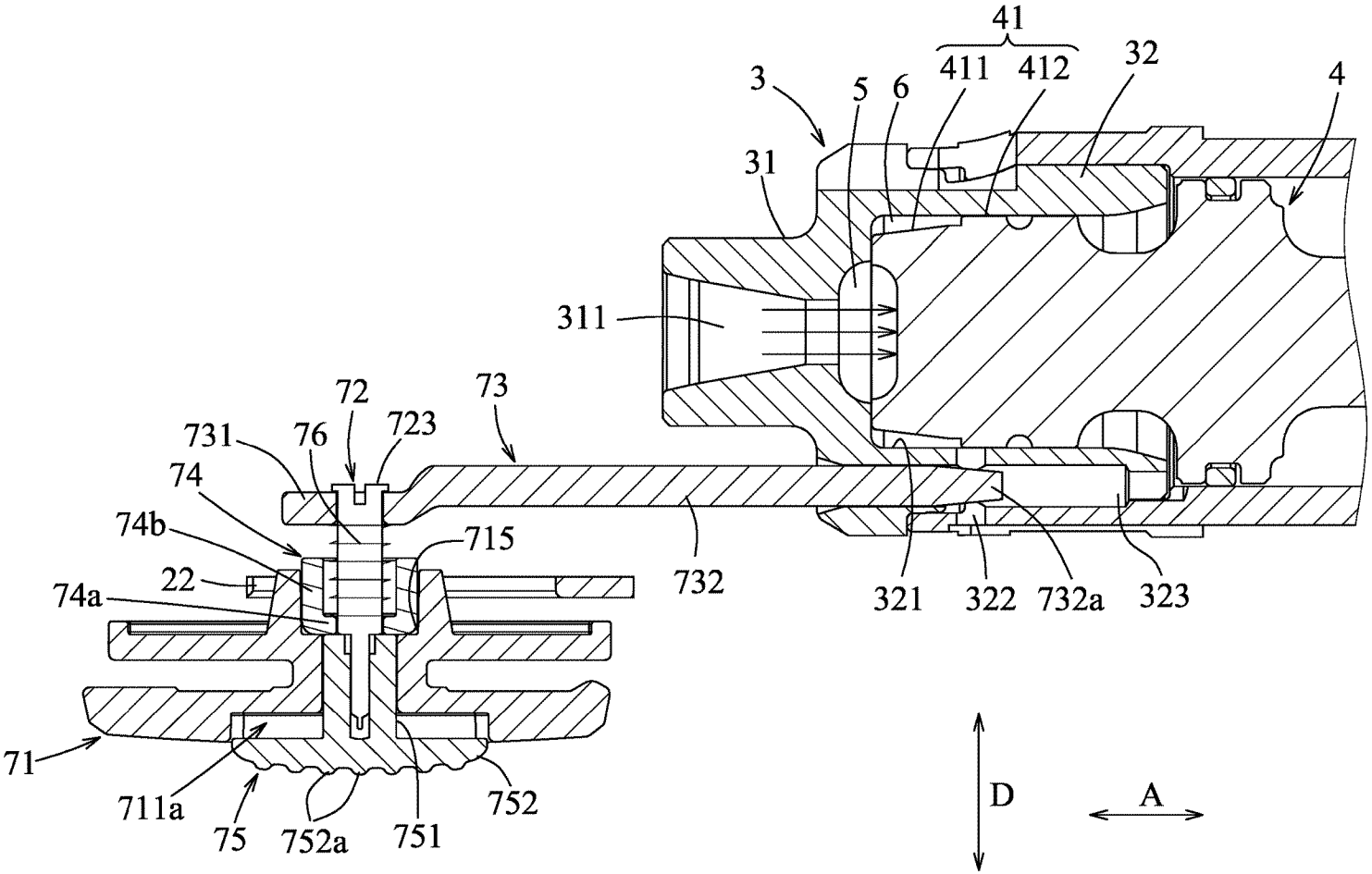
FIG. 8 is a fragmentary sectional view illustrating the embodiment in a state of middle striking power.

Referring to FIG. 7, the piston 4 with a high striking power is illustrated. In this state, the blocking region 732 of the adjusting pin 73 completely closes the exhaust port 322. The combustion gas is fully retained in the combustion chamber 5 when the discharge in the cartridge is exploded. Referring to FIG. 8, when a middle striking power is required, the adjusting pin 73 can be moved to have the tapered end surface (732*a*) of the front end registered with the exhaust port 322 so as to partially close the exhaust port 322.

Figure 9:
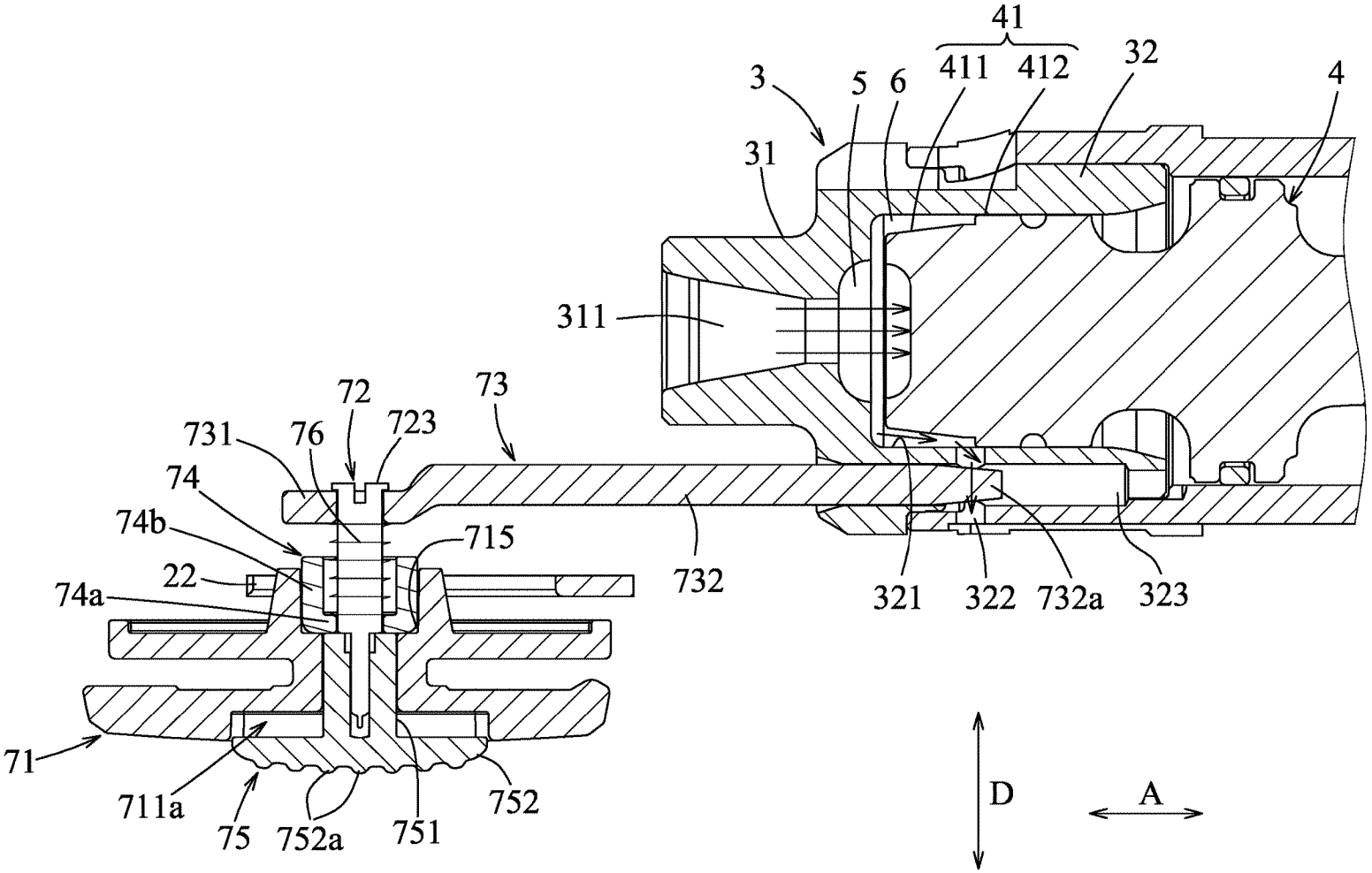
FIG. 9 is a fragmentary sectional view illustrating the embodiment in a pre-firing state.
Figure 10:
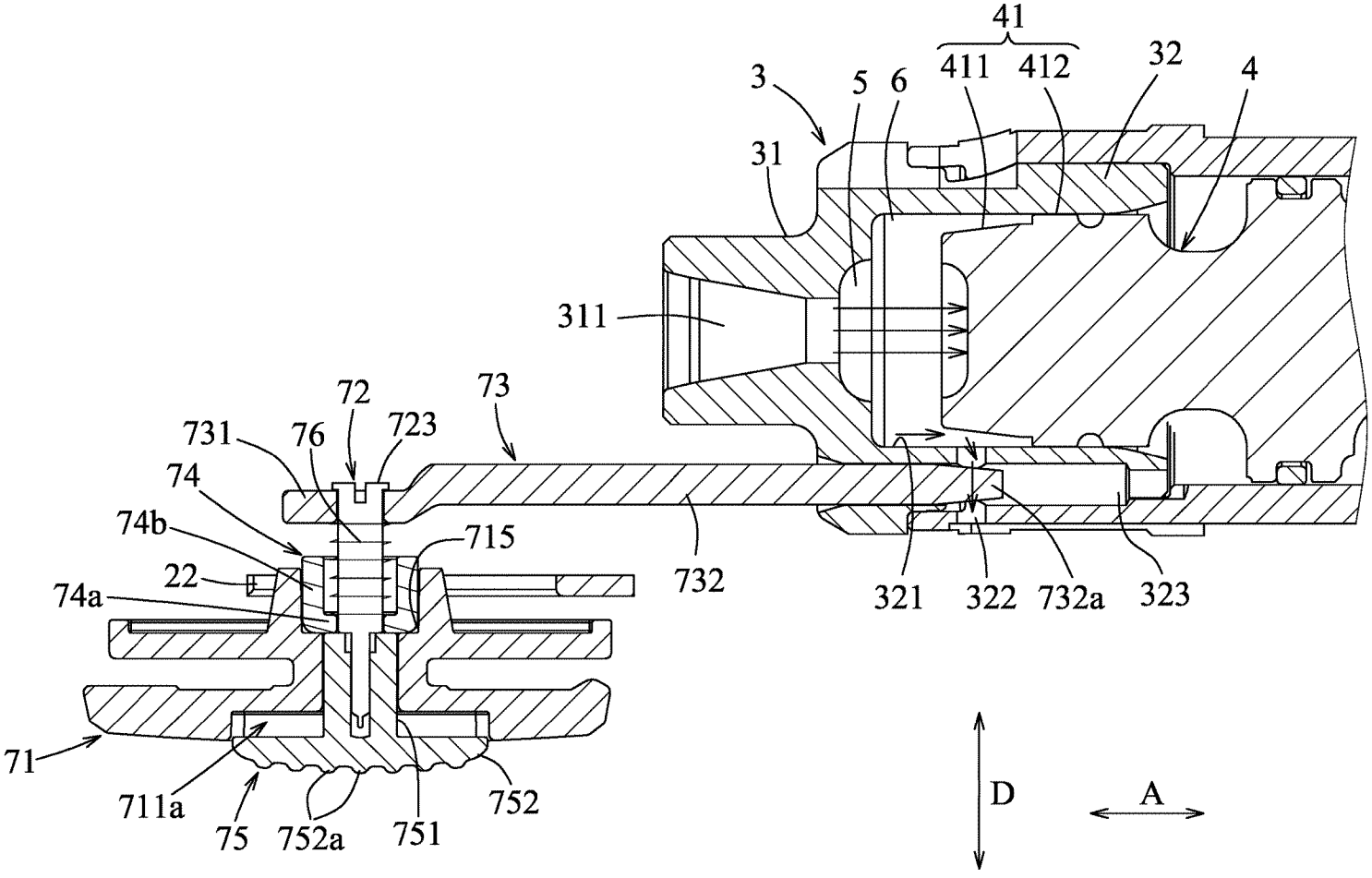
FIG. 10 is a fragmentary sectional view illustrating the embodiment in a firing state.

Referring to FIGS. 8 to 10, in a pre-firing state, the combustion chamber 5 is not in communication with the exhaust port 322. Upon explosion, the piston 4 is impelled progressively (see FIGS. 9 and 10) to permit communication of the combustion chamber 5 with the exhaust port 322 by virtue of the annular clearance 6 which is progressively in fluid communication with the exhaust port 322 in this case, thereby stably and smoothly regulating discharge of the combustion gas through the exhaust port 322 without causing undesired escape of the combustion gas. By virtue of the tapered end surface (732*a*) of the adjusting pin 73, progressive opening or closing of the exhaust port 322 is achieved.

Figure 11:
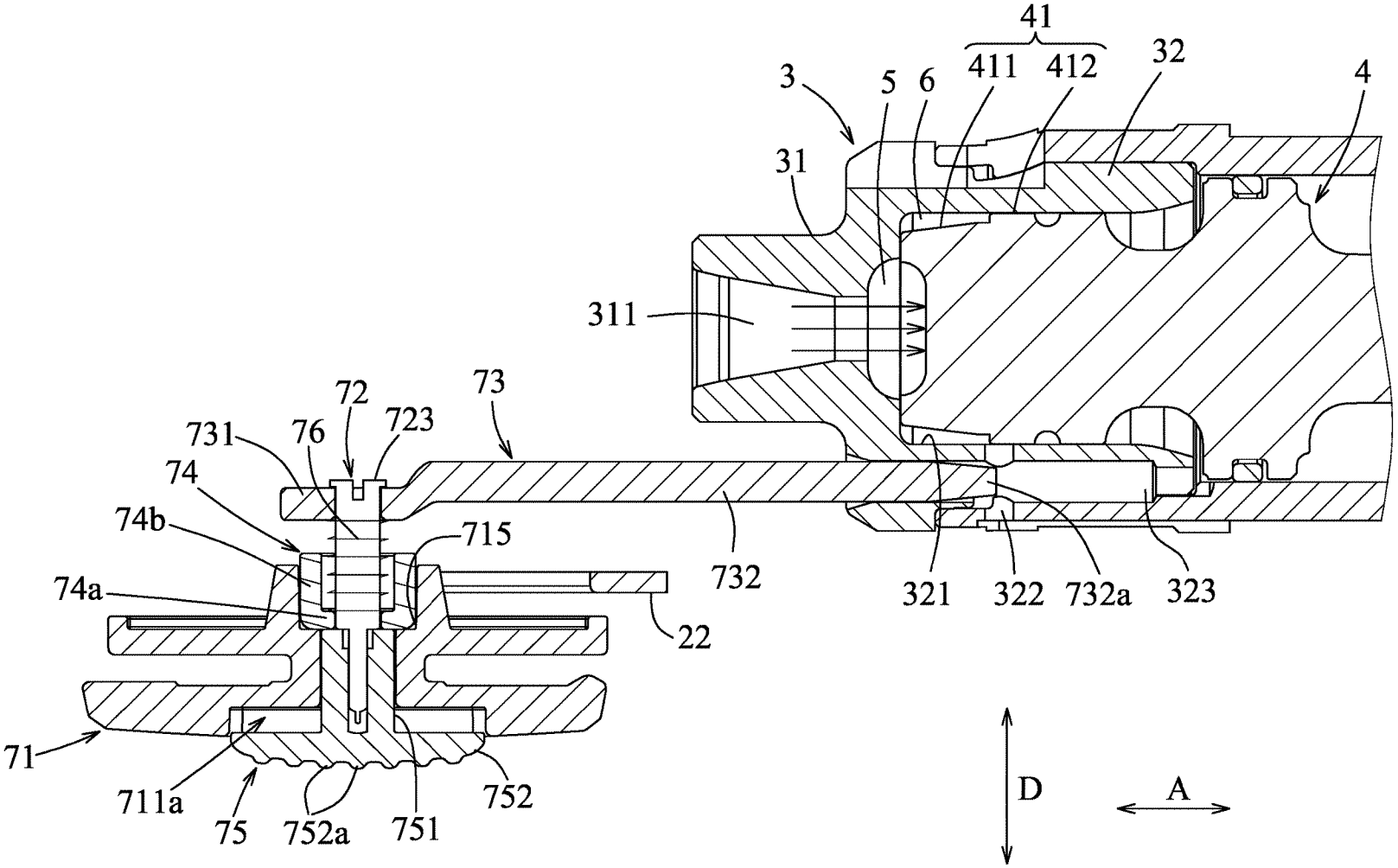
FIG. 11 is a fragmentary sectional view illustrating the embodiment in a state of low striking power.

Referring to FIG. 11, when a small striking power is required, the adjusting pin 73 is moved to have the blocking region 732 almost staying clear of the exhaust port 322 so as to permit more of the combustion gas to be discharged through the exhaust port 322.

Figure 12:
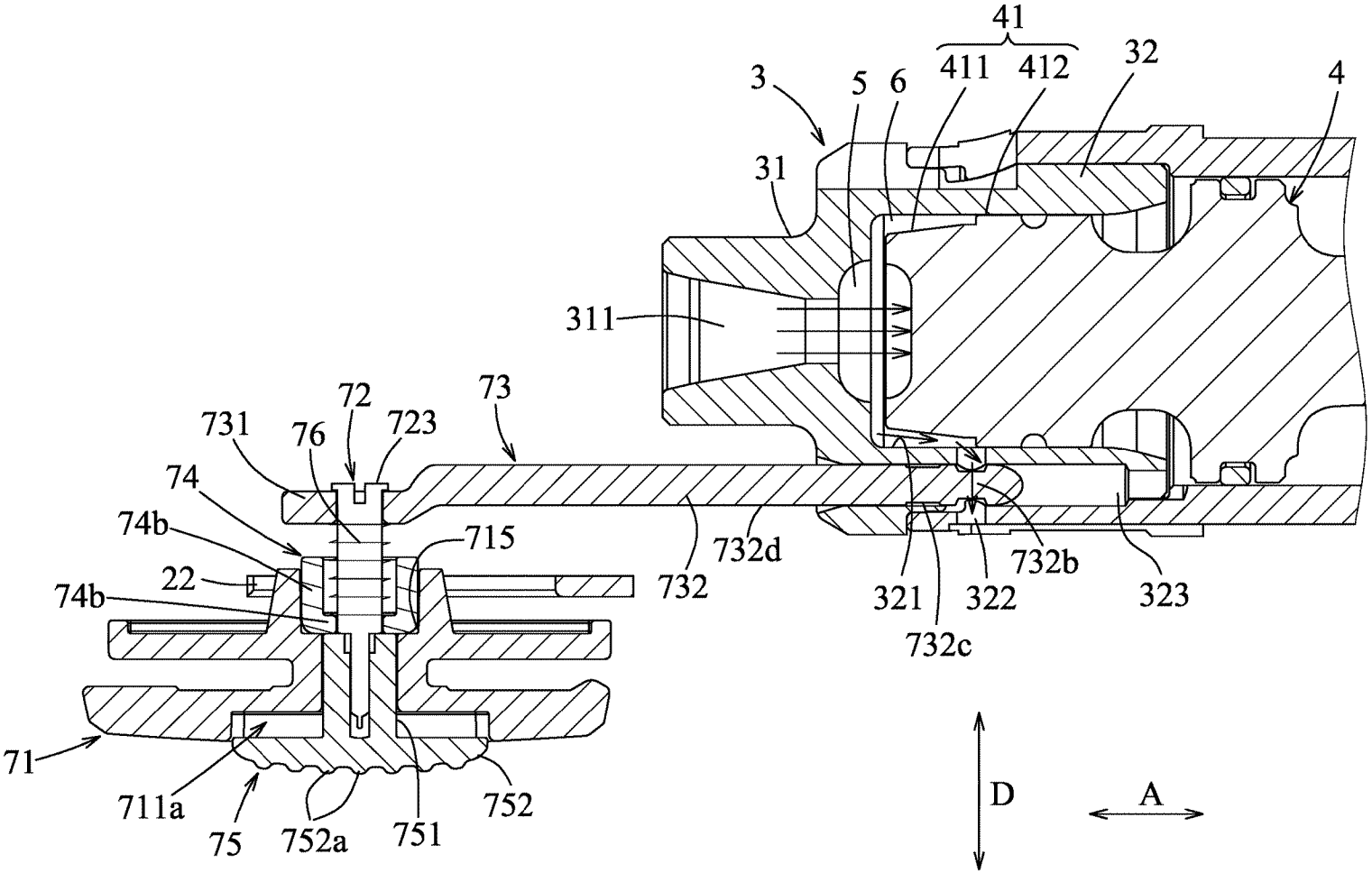
FIG. 12 is a fragmentary sectional view illustrating another embodiment of the explosive discharge actuated tool according to the disclosure.

Referring to FIG. 12, another embodiment of the explosive discharge actuated tool according to this invention is illustrated. In this embodiment, the blocking region 732 of the adjusting pin 73 includes a larger-diameter segment (732*d*), and first and second smaller-diameter segments (732*b*, 732*c*) displaced from each other in the longitudinal direction (A). The first smaller-diameter segment (732*b*) has a diameter smaller than that of the second smaller-diameter segment (732*c*) so as to adjust the opening of the exhaust port 322 in response to the movement of the adjusting pin 73 in the longitudinal direction (A). With such a structure, various levels of the striking power can be achieved by allowing the blocking region 732 to have different diameters. Further, by adjusting the diameter of each individual smaller-diameter segment, a desire of an even amount of striking power reduction between each level can be easily achieved.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An explosive discharge actuated tool for driving fasteners, comprising:

a tubular housing extending in a longitudinal direction, and having an opening which extends in a first transverse direction transverse to the longitudinal direction to define a mounting surface, and a plurality of retaining recesses which are disposed on said mounting surface, and which are displaced from each other in the longitudinal direction;

a barrel mounted in and movable relative to said tubular housing in the longitudinal direction, and including a rear segment defining an accommodation chamber for receiving an explosive cartridge, and a barrel body extending from said rear segment forwardly and defining a barrel bore which is in fluid communication with said accommodation chamber, said barrel body having an exhaust port which is located proximate to said rear segment and downstream of said accommodation chamber for discharging a combustion gas;

a piston disposed in said barrel bore and to be driven by the combustion gas so as to exert a striking power to strike a fastener out of said barrel, said piston having a trailing end disposed forwardly of said accommodation chamber to define, in a pre-firing position, a combustion chamber in said barrel bore so as to generate the combustion gas when the explosive cartridge detonated; and a power adjusting unit including an adjusting pin which has a blocking region and which is disposed to be movable relative to said barrel in the longitudinal direction so as to permit said blocking region to completely or partially close said exhaust port, a latch spindle having an actuated end and a latch end which is opposite to said actuated end in the first transverse direction, and which is disposed to be movable relative to said adjusting pin in the first transverse direction between a shiftable position where said latch spindle is movable with said adjusting pin in the longitudinal direction, and a non-shiftable position where said latch spindle is prevented from moving with said adjusting pin in the longitudinal direction, and an engaging block sleeved on and movable with said latch spindle in the first transverse direction and having a protuberance which is configured to be movable between an engaged position where said protuberance is engaged in a selected one of said retaining recesses so as to prevent said latch spindle from moving away from the non-shiftable position, and a disengaged position where said protuberance is disengaged from the selected one of said retaining recesses to place said latch spindle in the shiftable position.

2. The explosive discharge actuated tool of claim 1, wherein said power adjusting unit includes a mounting body which has socket cavity configured to engage said engaging block therein, and a through bore extending in the first transverse direction to communicate with said socket cavity;

an actuator disposed in and movable relative to said through bore such that, when actuated, said actuator pushes said actuated end and said engaging block to displace said protuberance from the engaged position to the disengaged position, thereby permitting said latch spindle to be moved in the longitudinal direction; and a biasing spring disposed to bias said protuberance to the engaged position.

3. The explosive discharge actuated tool of claim 2, wherein said engaging block has a tubular block body which is sleeved on said latch spindle, and which is fitted in and movable relative to said socket cavity, said mounting body having outward and inward surfaces opposite to each other in the first transverse direction for said through bore to extend therethrough, said outward surface having a receptacle recess extending inwardly;

said actuator including a stem which is fitted in and movable relative to said through bore between actuating and non-actuating positions, and an enlarged head which is connected to said stem, and which is configured to be fitted into said receptacle recess when said stem is moved from the non-actuating position to the actuating position.

4. The explosive discharge actuated tool of claim 3, wherein said tubular block body has a base wall having outer and inner wall surfaces, a surrounding wall extending from a periphery of said base wall in the first transverse direction and toward said adjusting pin, and two flanges extending from said surrounding wall in a second transverse direction transverse to both the longitudinal direction and the first transverse direction, said protuberance including two protuberance portions which are respectively disposed on said flanges, said stem being configured to abut against said outer wall surface, said biasing spring being configured to be sleeved on said latch spindle and disposed between said inner wall surface and said adjusting pin.

5. The explosive discharge actuated tool of claim 4, wherein said tubular housing includes a tubular body which is disposed for accommodating said barrel, and which has a rear end portion that is formed with a guiding groove extending in the longitudinal direction to guide movement of said power adjusting unit in the longitudinal direction, and a longitudinal bore extending in the longitudinal direction and in communication with said guiding groove.

6. The explosive discharge actuated tool of claim 5, wherein said tubular housing includes a shell body which is disposed to surround said tubular body and which has a cutout portion formed with an access bore, said tubular body having a side plate which is configured to confront said access bore, and which has a longitudinal slot to serve as said opening, said longitudinal slot extending in the second transverse direction to terminate at upper and lower surface regions that serve as said mounting surface, each of said retaining recesses having upper and lower recess portions which are respectively disposed on said upper and lower surface regions and which are configured to be engaged with said protuberance portions of said protuberance.

7. The explosive discharge actuated tool of claim 5, wherein said barrel has a shoulder surface extending between said rear segment and said barrel body, and having a guiding bore which extends in the longitudinal direction and which is aligned with said longitudinal bore to corporately form a guiding channel that is communicated with and extends forwardly from said exhaust port to permit a front end of said adjusting pin to be moved forwardly from said exhaust port so as to guide said blocking region of said adjusting pin to completely or partially close said exhaust port.

8. The explosive discharge actuated tool of claim 3, wherein said mounting body of said power adjusting unit has front and rear side surfaces which are disposed between said outward and inward surfaces and opposite to each other in the longitudinal direction, and which respectively have front and rear spacing gaps that respectively extend toward said through bore so as to form outer and inner shield segments.

9. The explosive discharge actuated tool of claim 8, wherein said tubular housing has an indexing plate mounted therein and having a front region which is disposed forwardly from said longitudinal slot, and which has a plurality of indentations that are disposed therein and that are displaced from each other in the longitudinal direction, and a rear region which is disposed above said longitudinal slot, said indexing plate being disposed between said outer and inner shield segments, wherein an inner surface of said outer shield segment has a protrusion configured to be frictionally engaged in one of said indentations.

10. The explosive discharge actuated tool of claim 9, wherein said mounting body of said power adjusting unit includes an index protrusion which is disposed on a top surface of said outer shield segment and above said through bore.

11. The explosive discharge actuated tool of claim 7, wherein said adjusting pin has a latched region which defines a latched hole, said latch end of said latch spindle being fitted in and movable relative to said latched hole, said blocking region being configured to extend to terminate at said front end which has a tapered end surface.

12. The explosive discharge actuated tool of claim 4, wherein said stem of said actuator has a central hole, said actuated end of said latch spindle being configured to be securely engaged in said central hole.

13. The explosive discharge actuated tool of claim 7, wherein said blocking region of said adjusting pin includes a larger-diameter segment and at least one smaller-diameter segment displaced from each other in the longitudinal direction so as to adjust opening of said exhaust port in response to the movement of said adjusting pin in the longitudinal direction.

* * * * *